US009966006B2

(12) United States Patent
Sun

(10) Patent No.: US 9,966,006 B2
(45) Date of Patent: May 8, 2018

(54) ORGANIC LIGHT-EMITTING DIODE PIXEL CIRCUIT, DISPLAY APPARATUS AND CONTROL METHOD

(71) Applicant: BOE TECHNOLOGY GROUP CO., LTD., Beijing (CN)

(72) Inventor: Liang Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 39 days.

(21) Appl. No.: 15/032,277

(22) PCT Filed: Jul. 24, 2015

(86) PCT No.: PCT/CN2015/085008
§ 371 (c)(1),
(2) Date: Apr. 26, 2016

(87) PCT Pub. No.: WO2016/155161
PCT Pub. Date: Oct. 6, 2016

(65) Prior Publication Data

US 2017/0116917 A1 Apr. 27, 2017

(30) Foreign Application Priority Data

Apr. 3, 2015 (CN) ..... 2015 1 0157745

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0842* (2013.01); *G09G 2320/0233* (2013.01)

(58) Field of Classification Search
CPC ..... G09G 3/3233; G09G 3/3266; G09G 2300/0842; G09G 2300/0852;
(Continued)

(56) References Cited

U.S. PATENT DOCUMENTS 7,310,078 B2 * 12/2007 Kim ..... G09G 3/3233 315/169.3
2007/0279337 A1 * 12/2007 Kim ..... G09G 3/3233 345/76
(Continued)

FOREIGN PATENT DOCUMENTS

CN 101276544 A 10/2008
CN 101281723 A 10/2008
(Continued)

OTHER PUBLICATIONS

First Office Action regarding Chinese application No. 201510157745.3, dated Aug. 2, 2016. Translation provided by Dragon Intellectual Property Law Firm.
(Continued)

*Primary Examiner* — Christopher E Leiby
(74) *Attorney, Agent, or Firm* — Harness, Dickey & Pierce, P.L.C.

(57) ABSTRACT

The present disclosure discloses an OLED pixel circuit, a display apparatus, and a control method. The OLED pixel circuit includes an OLED; a driving transistor a drain electrode of which is connected with the OLED; a first switching unit configured to output, during a light-emitting stage, a power source signal to a source electrode of the driving transistor; a second switching unit configured to output, during a present scanning stage, a data signal to a gate electrode of the driving transistor; a compensation unit having a capacitor, and a charging control unit configured to output, during a charging stage, a charging signal to the capacitor for charging the capacitor so that the capacitor can maintain, during the light-emitting stage, a voltage of the gate electrode of the driving transistor. The charging signal has a voltage value greater than an actual voltage value of the data signal.

18 Claims, 9 Drawing Sheets

(58) Field of Classification Search
CPC ... G09G 2300/0861; G09G 2320/0233; G09G 2320/045; G09G 2310/0262
See application file for complete search history.

(56) References Cited

U.S. PATENT DOCUMENTS

| | | | | |
|---|---|---|---|---|
| 2008/0111804 | A1* | 5/2008 | Choi | G09G 3/3233 345/205 |
| 2008/0315759 | A1* | 12/2008 | Chung | G09G 3/3233 313/504 |
| 2010/0220093 | A1* | 9/2010 | Choi | G09G 3/3233 345/213 |
| 2011/0102403 | A1 | 5/2011 | Kim | |
| 2011/0109531 | A1* | 5/2011 | Choi | G09G 3/3233 345/76 |
| 2011/0227904 | A1* | 9/2011 | Choi | G09G 3/3233 345/212 |
| 2014/0210867 | A1* | 7/2014 | Kwon | G09G 3/3258 345/690 |
| 2014/0340290 | A1* | 11/2014 | Ono | G09G 3/3233 345/77 |
| 2016/0314742 | A1* | 10/2016 | Zhou | G09G 3/3258 |
| 2017/0039944 | A1* | 2/2017 | Ma | G09G 3/325 |

FOREIGN PATENT DOCUMENTS

| | | | |
|---|---|---|---|
| CN | 102044212 | A | 5/2011 |
| CN | 102708819 | A | 10/2012 |
| CN | 103021331 | A | 4/2013 |
| CN | 103839517 | A | 6/2014 |
| CN | 104025176 | A | 9/2014 |
| CN | 104282263 | A | 1/2015 |
| CN | 104485074 | A | 4/2015 |
| CN | 104700782 | A | 6/2015 |
| CN | 204614415 | U | 9/2015 |
| KR | 100821041 | B1 | 4/2008 |
| KR | 20140129578 | A | 11/2014 |

OTHER PUBLICATIONS

Written Opinion of the International Searching Authority for international application No. PCT/CN2015/085008.

* cited by examiner

ORGANIC LIGHT-EMITTING DIODE PIXEL CIRCUIT, DISPLAY APPARATUS AND CONTROL METHOD

CROSS-REFERENCE TO RELATED APPLICATION

This application is the U.S. national phase of PCT Application No. PCT/CN2015/085008 filed on Jul. 24, 2015, which claims a priority of the Chinese Patent Application No. 201510157745.3 filed on Apr. 3, 2015, the disclosures of which are incorporated in their entirety by reference herein.

TECHNICAL FIELD

The present disclosure relates to the field of display technology, in particular to an organic light-emitting diode (OLED) pixel circuit, a display apparatus, and a control method.

BACKGROUND

As a display apparatus, an organic light-emitting diode (OLED) is self-luminous, has a high contrast ratio, and has a wide color gamut. Besides these advantages, OLED has a simple manufacturing process, has a low power consumption, and is easy to realize flexible display. Thus, OLED becomes an important light-emitting element in a new flat panel display apparatus.

For the pixels of OLED display panel, each pixel includes a driving transistor. In an organic light-emitting diode pixel circuit, a current flowing though the OLED is not only controlled by a data signal Vdata, but also affected by a threshold voltage Vth of the driving transistor.

In different pixel circuits, characteristics such as the threshold voltage and carrier mobility of the TFT are different from each other, and the driving transistor included in each OLED pixel circuit cannot have exactly same performance parameters. Thus, currents flowing through the OLEDs may be different caused by a threshold voltage shift (Vth Shift) in the driving transistor. This may finally cause adverse effect to the luminance uniformity and constant brightness of the organic light-emitting diode display apparatus, and accordingly adversely affects a display effect of the organic light-emitting diode display apparatus.

With consideration of the above-described points, it is necessary to provide a threshold voltage compensation circuit to the pixel circuit in order to avoid the adverse effect caused by the threshold voltage shift to the luminance uniformity and constant brightness of the organic light-emitting diode display apparatus.

Usually, a threshold voltage compensation circuit may output a charging signal to a capacitor during a charging stage in order to charge the capacitor so that the capacitor can maintain a voltage of the gate electrode of the driving transistor during the light-emitting stage. With this configuration, the current flowing through OLED can be controlled to have no relation to the threshold voltage Vth of the driving transistor.

However, in the driving circuit according to the prior art, in some cases, a design of the data signal is restricted by the power source, and this may lower a design flexibility.

SUMMARY

An object of the present disclosure is to provide an OLED pixel circuit and a display apparatus, which can improve a design flexibility of a driving circuit and a credibility of threshold voltage compensation.

In order to achieve the above object, the present disclosure provides in an embodiment an organic light-emitting diode (OLED) pixel circuit, which includes: an OLED; a driving transistor, a drain electrode of which is connected with the organic light-emitting diode; a first switching unit configured to output a power source signal to a source electrode of the driving transistor during a light-emitting stage; a second switching unit configured to output a data signal to a gate electrode of the driving transistor during a present scanning stage; and a compensation unit including a capacitor, the compensation unit being connected with the gate electrode of the driving transistor, a first end of the capacitor being connected with the source electrode of the driving transistor, and the compensation unit being configured to maintain a voltage of the gate electrode of the driving transistor during the light-emitting stage so that a current flowing through the OLED has no relation to a threshold voltage Vth of the driving transistor. The OLED pixel circuit further includes a charging control unit configured to output, during a charging stage, a charging signal to the capacitor to charge the capacitor so that the capacitor is capable of maintaining the voltage of the gate electrode of the driving transistor during the light-emitting stage, a voltage value of the charging signal being greater than an actual voltage value of the data signal.

Alternatively, the charging control unit includes: a signal generation unit configured to generate and outputting the charging signal; and a third switching unit configured to output, during the charging stage, the charging signal, which is generated by the signal generation unit, to the capacitor.

Alternatively, the charging signal for different frames is identical, and the voltage value of the charging signal is greater than a maximum value of possible voltage values of the data signal.

Alternatively, there is a corresponding charging signal for each frame, and a voltage value of the charging signal is equal to a sum of the actual voltage value of the data signal outputted for a corresponding frame during the scanning stage and a predetermined voltage value set to be greater than zero.

Alternatively, the first switching unit is a thin film transistor a source electrode of which is connected with an output end of a power source signal, a drain electrode of which is connected with the source electrode of the driving transistor, a gate electrode of which is connected with an output end of a light-emitting control signal, and which is turned on when the light-emitting control signal is in an effective state, wherein the light-emitting control signal is in the effective state during the light-emitting stage. And the second switching unit is a thin film transistor, a source electrode of which is connected with an output end of the data signal, a drain electrode of which is connected with the gate electrode of the driving transistor, a gate electrode of which is connected with an output end of a present scanning signal, and which is turned on when a present scanning signal is in an effective state, wherein the present scanning signal is in the effective state during the present scanning stage.

Alternatively, the compensation unit further includes: a fourth switching unit configured to output, during a present scanning stage, a reference voltage to a second end of the capacitor; and a fifth switching unit configured to electrically connect, during the light-emitting stage, the second end of the capacitor with the gate electrode of the driving transistor.

Alternatively, the fourth switching unit is a thin film transistor, a source electrode of which is connected with an output end of a reference signal, a drain electrode of which is connected with the second end of the capacitor, a gate electrode of which is connected with an output end of a present scanning signal, and which is turned on when the present scanning signal is in an effective state, wherein the present scanning signal is in the effective state during the present scanning stage. And the fifth switching unit is a thin film transistor, a source electrode of which is connected with the gate electrode of the driving transistor, a drain electrode of which is connected with the second end of the capacitor, a gate electrode of which is connected with an output end of the light-emitting control signal, and which is turned on when the light-emitting control signal is in an effective state, wherein the light-emitting control signal is in the effective state during the light-emitting stage.

Alternatively, a start time of the charging stage is identical to a start time of the present scanning stage, and an end time of the charging stage is earlier than an end time of the present scanning stage.

Alternatively, an end time of the charging state is earlier than a start time of the present scanning stage.

Alternatively, the third switching unit is a thin film transistor, a source electrode of which is connected with an output end of the signal generation unit, a drain electrode of which is connected with the source electrode of the driving transistor, a gate electrode of which is connected with an output end of a previous scanning signal, and which is turned on when the previous scanning signal is in an effective state, wherein the previous scanning signal is in the effective state during an previous scanning stage.

Alternatively, the above-described OLED pixel circuit further includes a thin film transistor, a source electrode of which is connected with an output end of the reference signal, a drain electrode of which is connected with the second end of the capacitor, a gate electrode of which is connected with an output end of the previous scanning signal, and which is turned on when the previous scanning signal is in an effective state, wherein the previous scanning signal is in the effective state during the previous scanning stage.

In another aspect, an embodiment of the present disclosure discloses a display apparatus which includes the above-described OLED pixel circuit.

In yet another aspect, an embodiment of the present disclosure discloses a control method of the OLED pixel circuit. Here, the OLED pixel circuit includes a compensation unit having a capacitor. The control method includes: a charging control step of outputting, during a charging stage, a charging signal to the capacitor for charging the capacitor so that the capacitor is capable of maintaining a voltage of a gate electrode of a driving transistor during a light-emitting stage, the charging signal having a voltage value greater than an actual voltage value of a data signal; a writing step of outputting, during a present scanning stage, the data signal to the gate electrode of the driving transistor; and a light-emitting step of outputting, during a light-emitting stage, a power source signal to a source electrode of the driving transistor.

Alternatively, the charging signal for different frames is identical, and the voltage value of the charging signal is greater than a maximum value of possible voltage values of the data signal.

Alternatively, there is a corresponding charging signal for each frame, and a voltage value of the charging signal is equal to a sum of the actual voltage value of the data signal outputted for a corresponding frame during the scanning stage and a predetermined voltage value set to be greater than zero.

Alternatively, a start time of the charging stage is identical to a start time of the present scanning stage, and an end time of the charging stage is earlier than an end time of the present scanning stage.

Alternatively, an end time of the charging stage is earlier than a start time of the present scanning stage.

Alternatively, the charging state is a previous scanning stage.

The embodiments of the present disclosure provide the following advantages.

In the embodiment of the present disclosure, a charging signal Vini, which is purposely designed to have a voltage value greater than an actual voltage value of the data signal, is used for charging the capacitor Cst, instead of the power source signal which is used as the charging signal in the related art. This configuration can avoid a problem that many factors need to be considered in the data signal design caused by the various factors which are necessary to be considered in the power source signal. In the embodiment of the present disclosure, the charging signal Vini is only used to charge the capacitor Cst. Thus, the factors need to be considered are reduced compared with a case where the power source signal is used in the charging. Thus, restriction on the data signal is substantially reduced compared with the restriction of the power source signal on the data signal, and the design flexibility of the driving circuit is improved.

Further, from a viewpoint of the threshold voltage compensation, in the driving circuit according to the embodiment of the present disclosure, the charging signal Vini outputted from the charging control unit is used to charge the capacitor, and the charging signal has a voltage value greater than the actual voltage value of the data signal. Thus, the voltage value of the signal applied to the gate electrode of the driving transistor is avoided from being greater than the voltage value of the signal applied to the source electrode of the driving transistor. This configuration secures the driving transistor to be turned on, and the threshold voltage Vth can be properly written into the capacitor Cst, and thus secures a proper operation of the threshold voltage compensation.

DETAILED DESCRIPTION

An object of the embodiments of the present disclosure is to provide an OLED pixel circuit and a display apparatus, in which a capacitor is charged by a charging signal, which is purposely designed to have a voltage value greater than an actual voltage value of the data signal, instead of a charging signal provided by the power source signal. With this configuration, restriction to the data signal design caused by the power source signal can be avoided, and the design flexibility of the OLED pixel circuit is improved. At the same time, a credibility of the threshold voltage compensation is improved.

The inventor of the present disclosure found, by own creative effort, that the driving circuit of the OLED pixel has the following problem. The power source signal and the data signal are restricted by each other, and this causes low design flexibility of the driving circuit of the OLED pixel and low credibility of the threshold voltage compensation. The following will describe the problem in details.

Figure 1:
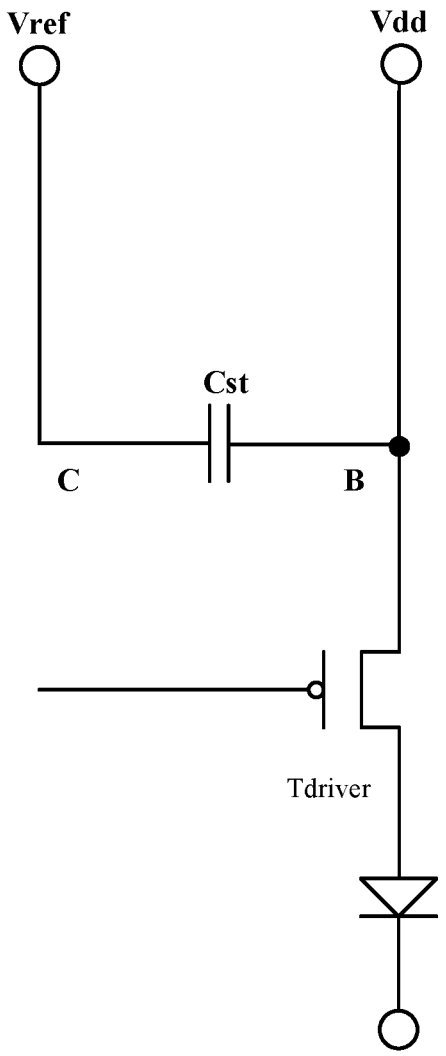
FIG. 1 is a schematic view showing a charging stage in which a capacitor is charged by a power source signal.

As shown in FIG. 1, in a conventional driving circuit, a power source signal VDD is used to charge a capacitor Cst during a charging stage. Thus, after the charging is ended, a node B has a voltage value of VDD.

Then, in order to secure that the capacitor can maintain a voltage of the gate electrode of a driving transistor during a light-emitting stage to make the current flowing through the OLED has no relation to the threshold voltage Vth of the driving transistor, the threshold voltage Vth needs to be written into the capacitor Cst. That is, the voltage of the node B needs to be maintained to be equal to a sum of the absolute value of the voltage value of the data signal Vdata and the absolute value of the threshold voltage Vth of the driving transistor.

In the following stages, when the voltage value of Vdata applied to the gate electrode of the driving transistor is greater than the voltage value of the VDD applied to the source electrode, the driving transistor Tdriver may be in an off state. Thus, the capacitor Cst is in an open circuit state and the threshold voltage Vth cannot be written into the capacitor Cst. When the threshold voltage Vth cannot be written into Cst, the compensation of the threshold voltage cannot be achieved.

The above problem can be analyzed in the following two aspects.

1. In order to properly compensate the threshold voltage, a voltage design of each Vdata requires a consideration of VDD. That is, the voltage design of Vdata is restricted by VDD. As a power source signal, VDD has a lower voltage than a power source voltage and a design of the power source needs to consider many factors, then these factors may finally affect the design of Vdata and restrict a design of Vdata. Thus, a design flexibility of the driving circuit may be deteriorated.

2. When the voltage value of Vdata can be flexibly designed, in some cases, the voltage value of Vdata may be greater than the voltage value of VDD, and the threshold compensation function may become ineffective. This may cause adverse effect to the luminance uniformity and the constant brightness of the organic light-emitting diode display apparatus.

Figure 2:
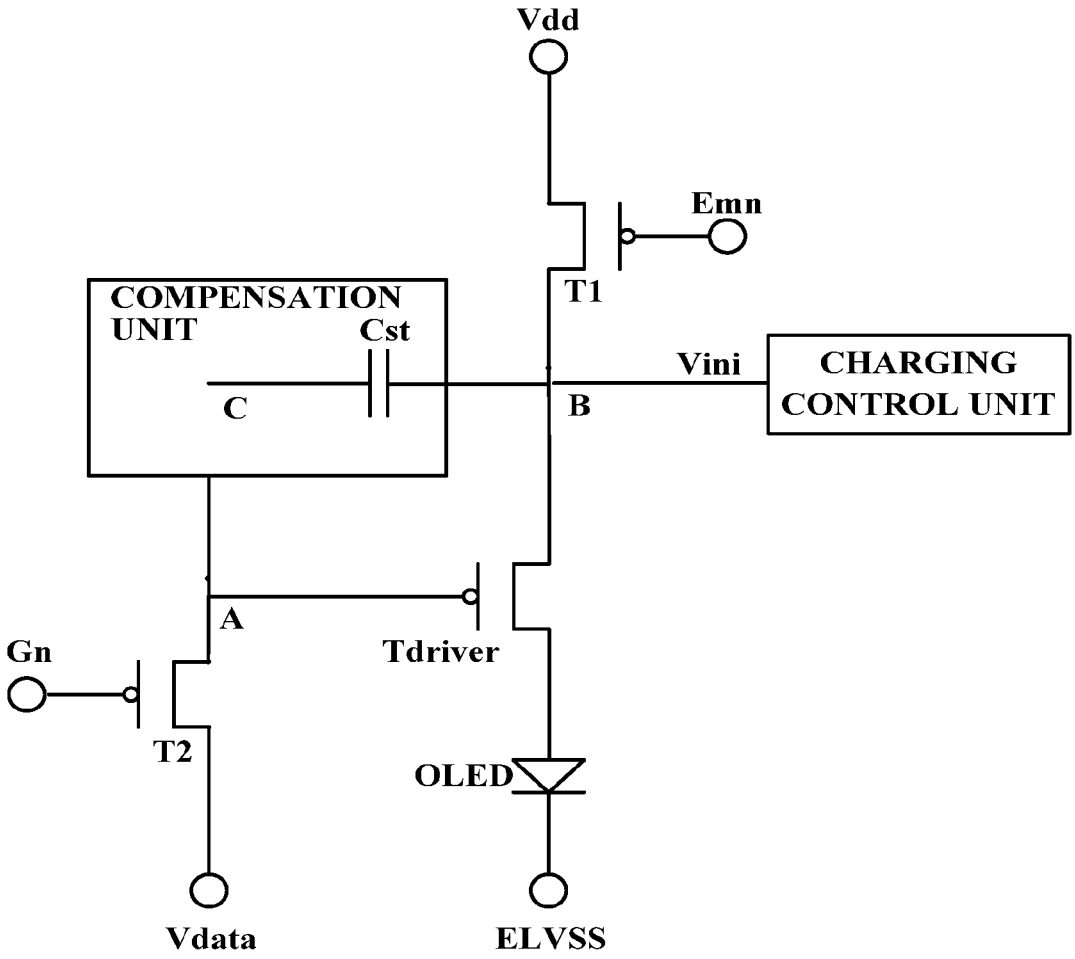
FIG. 2 is a schematic view showing a configuration of a driving circuit according to an embodiment of the present disclosure.

With considering the above problems, the present disclosure provides in an embodiment an OLED pixel circuit, as shown in FIG. 2, including an OLED;

a driving transistor Tdriver, a drain electrode of which is connected with the OLED;

a first switching unit T1 configured to output a power source signal VDD to a source electrode of the driving transistor Tdriver during a light-emitting stage;

a second switching unit T2 configured to output a data signal Vdata to a gate electrode of the driving transistor Tdrive during a present scanning stage; and a compensation unit including a capacitor Cst, the compensation unit being connected with the gate electrode of the driving transistor Tdrive, a first end (i.e., node B) of the capacitor being connected with the source electrode of the driving transistor Tdrive, and the compensation unit being configured to maintain a voltage of the gate electrode of the driving transistor Tdrive during the light-emitting stage so that a current flowing through the OLED has no relation to a threshold voltage Vth of the driving transistor Tdrive.

The OLED pixel circuit further includes a charging control unit configured to output, during a charging stage, a charging signal Vini to the capacitor Cst to charge the capacitor Cst so that the capacitor Cst is capable of maintaining the voltage of the gate electrode of the driving transistor Tdrive during the light-emitting stage. A voltage value of the charging signal Vini is greater than an actual voltage value of the data signal Vdata.

It should be understood that although the first switching unit and the second switching unit are described by taking thin film transistors as an example, as shown in FIG. 2, other switching module capable of being controlled to be turned on during a certain period can be used in the embodiment of the present disclosure, and the detailed description will be omitted.

In the driving circuit according to the embodiment of the present disclosure, a charging signal Vini, which is purposely designed to have a voltage value greater than an actual voltage value of the data signal, instead of the power source signal which is used as the charging signal in the related art, is used for charging the capacitor Cst. This configuration can avoid a problem that many factors need to be considered in the data signal design caused by the various factors which are necessary to be considered in the power source signal. In the embodiment of the present disclosure, the charging signal Vini only used to charge the capacitor Cst. Thus, the factors need to be considered are reduced compared with a case where the power source signal is used in the charging. Thus, restriction on Vdata is substantially reduced compared with the restriction of VDD on Vdata, and design flexibility of the driving circuit is improved.

Further, from a viewpoint of the threshold voltage compensation, in the driving circuit according to the embodiment of the present disclosure, the charging signal Vini outputted from the charging control unit is used to charge the capacitor, and the charging signal has a voltage value greater than the actual voltage value of the data signal. Thus, the voltage value of the signal applied to the gate electrode of the driving transistor is avoided from being greater than the voltage value of the signal applied to the source electrode of the driving transistor. This configuration secures the driving transistor can be turned on, and the threshold voltage Vth can be properly written into the capacitor Cst, thereby ensuring a proper operation of the threshold voltage compensation.

In the specific embodiment of the present disclosure, the charging control unit includes a signal generation unit configured to generate and output the charging signal, and a third switching unit configured to output, during the charging stage, the charging signal, which is generated by the signal generation unit, to the capacitor.

In the specific embodiment of the present disclosure, the third switching unit may be realized by a thin film transistor. Alternatively, the third switching unit may be realized by another means, and the detailed description will be omitted.

In the specific embodiment of the present disclosure, in each frame, the voltage value of the charging signal should be greater than the actual voltage value of the data signal of the current frame. During an operation process of the pixel, Vdata may be different in each frame. However, Vdata has a maximum value among all the possible voltage values.

Thus, with consideration of the above-described needs, as a relatively simple design, a charging signal may be set to have a voltage value greater than the maximum value of the possible voltage values of the data signal. With this configuration, in each frame, it can be secured that the voltage value of the charging signal is greater than the actual voltage value of the data signal of the present frame.

In the above method, only one charging signal needs to be designed. Thus, the design is easy to be realized. However, during the image display process, the voltage value of the data signal changes at any time. In most cases, the voltage value of the data signal is smaller than the maximum value of all of the possible voltage values. However, when Vini has a relatively great voltage value, the power consumption of the driving circuit may be increased. Thus, in the specific embodiment of the present disclosure, it is merely needed that the voltage value of the charging signal is greater than the actual voltage value of the data signal in a present frame.

Specifically, in order to reduce power consumption of the driving circuit, in the specific embodiment of the present disclosure, a charging signal is set corresponding to each frame. The voltage value of the charging signal set corresponding to each frame is equal to a sum of the actual voltage value of the data signal outputted for the corresponding frame during the scanning stage and a predetermined voltage value set to be greater than zero.

In a second realizing method of the charging signal according to the embodiment of the present disclosure, the charging signal is designed based on the voltage value of the present data signal. In this method, the charging signal is provided according to the needs. When the voltage value of the data signal is relatively great, the voltage value of the charging signal is relatively great. When the voltage value of the data signal decreases, the voltage value of the charging signal decreases correspondingly. Compared with the design in which the charging signal is always greater than the maximum value among all of the possible voltage values of the data signal, an average voltage of the charging signal is decreased and the power consumption of the driving circuit is reduced.

In the specific embodiment of the present disclosure, as shown in FIG. 2, the first switching unit is a thin film transistor T1. With respect to the thin film transistor T1, a source electrode is connected with an output end of the power source signal VDD, a drain electrode is connected with the source electrode of the driving transistor Tdriver, the gate electrode is connected with an output end of the light-emitting control signal Emn, and it is turned on when the light-emitting control signal Emn is in an effective state. Herein, the light-emitting control signal is in the effective state during the light-emitting stage.

The second switching unit is a thin film transistor T2. With respect to the thin film transistor T2, a source electrode is connected with an output end of the data signal Vdata, a drain electrode is connected with the gate electrode of the driving transistor Tdriver, a gate electrode is connected with an output end of a present scanning signal Gn, and it is turned on when the present scanning signal Gn is in an effective state. Herein, the present scanning signal is in the effective state during the present scanning stage.

During the operation process of the driving circuit, in order to control Cst to maintain the voltage of the gate electrode of the driving transistor Tdriver during the light-emitting stage and ensure that the current flowing through the OLED has no relation to the threshold voltage Vth of the driving transistor Tdriver, the second end of Cst needs to be electrically connected with the gate electrode of the driving transistor during the light-emitting stage. Further, during the scanning stage, in order to avoid Cst to be in a floating state, a reference voltage needs to be outputted to the second end of the capacitor. Thus, in the specific embodiment of the present disclosure, the compensation unit further includes a fourth switching unit configured to output, during the present scanning stage, a reference voltage to a second end of the capacitor, and a fifth switching unit configured to electrically connect, during the light-emitting stage, the second end of the capacitor with the gate electrode of the driving transistor.

Figure 3:
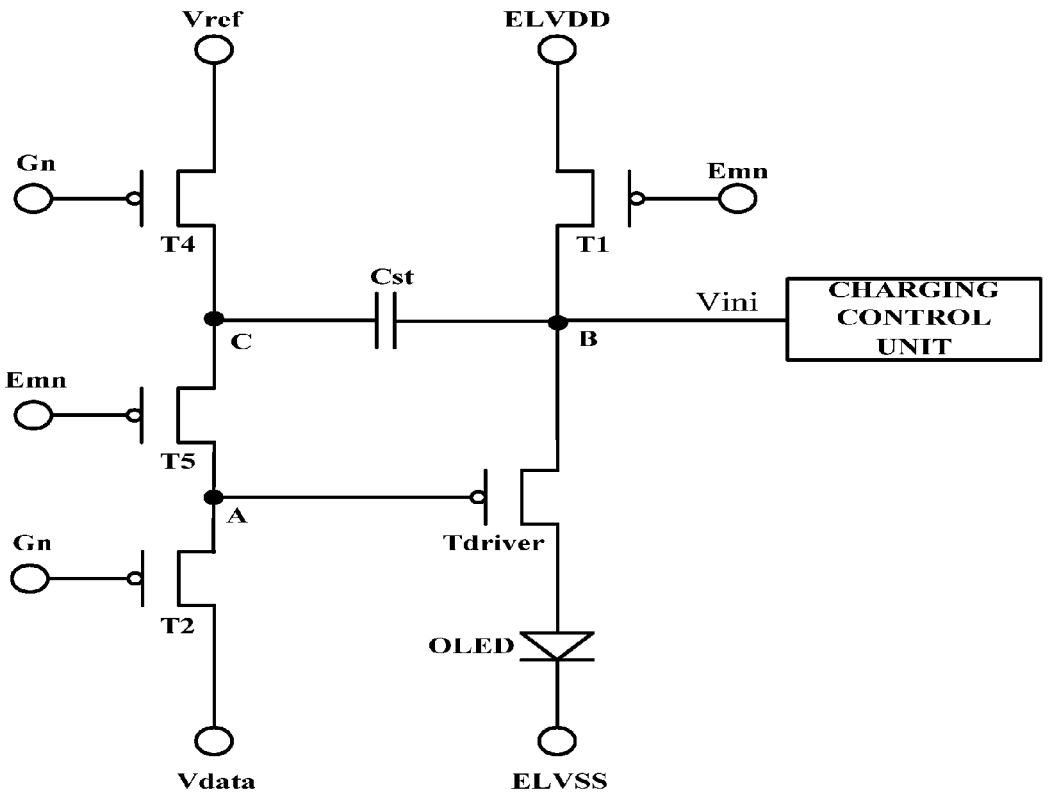
FIG. 3 is a schematic view showing a configuration of a driving circuit including a full compensation unit according to an embodiment of the present disclosure.

As shown in FIG. 3, the fourth switching unit is a thin film transistor T4 a source electrode of which is connected with an output end of a reference signal Vref, a drain electrode of which is connected with a second end (node C) of the capacitor Cst, a gate electrode of which is connected with an output end of the present scanning signal Gn, and which is turned on when the present scanning signal Gn is in an effective state. Here, the present scanning signal Gn is in the effective state during the present scanning stage.

The fifth switching unit is a thin film transistor T5, a source electrode of which is connected with the gate electrode of the driving transistor Tdriver, a drain electrode of which is connected with the second end of the capacitor Cst, a gate electrode of which is connected with an output end of the light-emitting control signal Emn, and which is turned on when the light-emitting control signal Emn is in an effective state. Here, the light-emitting control signal is in the effective state during the light-emitting stage.

By providing T4 and T5, Cst can be secured in a connected state during the scanning stage and Vth can be written into Cst. Thus, during the light-emitting stage, the voltage of the gate electrode of the driving transistor Tdriver can be maintained by Cst so that the current flowing through the OLED has no relation to the threshold voltage Vth of the driving transistor Tdriver.

Based on the above description, it can be found that in the embodiments of the present disclosure, the charging stage and the present scanning stage are included, and the charging stage can be overlapped with the present scanning stage. That is, a start time of the charging stage may be identical to a start time of the present scanning stage, and an end time of the charging stage may be earlier than an end time of the present scanning stage.

In the OLED driving circuit having the compensation structure, at least three operations need to be completed in one cycle. The three operations include charging the capacitor, writing Vth into the capacitor, maintaining light emitting of the OLED. When the charging stage is overlapped with the present scanning stage, the former two operations need to be completed before the light-emitting stage, that is, need to be completed in one scanning stage.

With an increase of resolution of the display device, duration of one scanning stage has become shorter. When the duration of one scanning stage decreases, the duration used for charging the capacitor and writing Vth into the capacitor decreases correspondingly. However, a full charging of the capacitor and a complete writing of Vth into the capacitor require sufficient time to be carried out.

Thus, a design of overlapping the charging stage and the present scanning stage causes adverse effect to the increase of the resolution, or cannot be adopted in the display device having a relatively high resolution.

In order to solve the above problem, in the specific embodiment of this aspect, the charging stage can be set to be separated from the scanning stage. That is, an end time of the charging stage may be set earlier than a start time of the present scanning stage.

With the above design, the scanning stage can be fully used for writing Vth into the capacitor, and the charging of the capacitor is preliminarily carried out using a time duration prior to the scanning stage. Thus, in the overall, the duration for charging the capacitor and the duration for writing Vth into the capacitor are increased, and these two operations have no need to be completed in one scanning stage. This configuration enables an increase of the resolution, and at the same time, secures full charging of the capacitor and complete writing of Vth into the capacitor. Thus, the compensation of the threshold voltage is realized.

Figure 4:
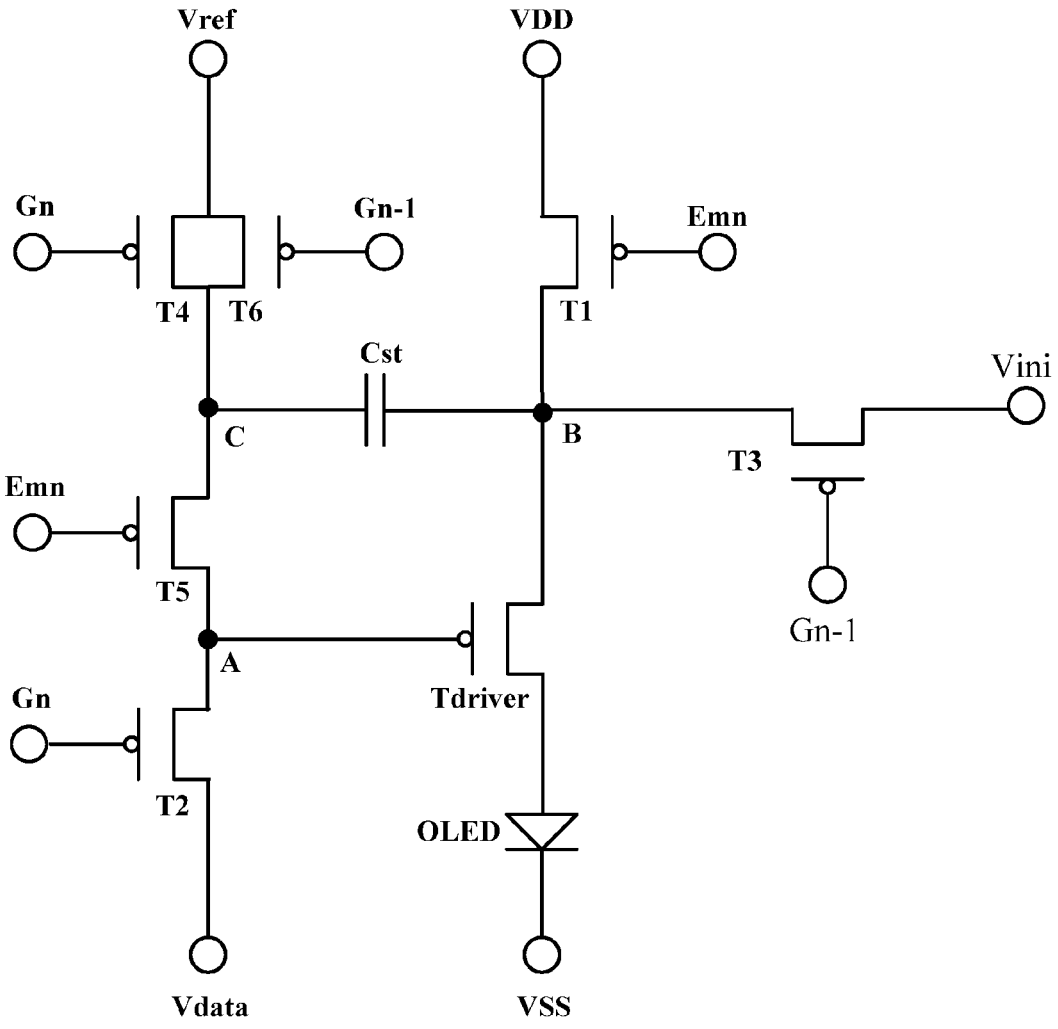
FIG. 4 is a schematic view showing a configuration of a driving circuit in which charging and Vth writing are performed separately according to an embodiment of the present disclosure.

In the embodiments of the present disclosure, as shown in FIG. 4, the third switching unit is a thin film transistor T3, a source electrode of which is connected with an output end of the signal generation unit, a drain electrode of which is connected with the source electrode of the driving transistor, a gate electrode of which is connected with an output end of a previous scanning signal, and which is turned on when the previous scanning signal is in an effective state. Here, the previous scanning signal is in the effective state during a previous scanning stage.

In the embodiment of the present disclosure, a pre-charging can be carried out to the capacitor during the previous scanning stage in order to differentiate the charging stage from the writing stage of Vth into the capacitor. This configuration enables an increase of the resolution, and at the same time, realizes the compensation of the threshold voltage.

When performing the charging during the previous scanning stage, Cst should not be floated. Thus, as shown in FIG. 4, the OLED pixel circuit further includes a thin film transistor T6, a source electrode of which is connected with an output end of a reference signal, a drain electrode of which is connected with the second end of the capacitor, a gate electrode of which is connected with an output end of the previous scanning signal, and which is turned on when the previous scanning signal is in an effective state. Here, the previous scanning signal is in the effective state during the previous scanning stage.

The following will describe an operation process of the driving circuit according to the embodiment of the present disclosure with reference to FIG. 4.

Figure 5:
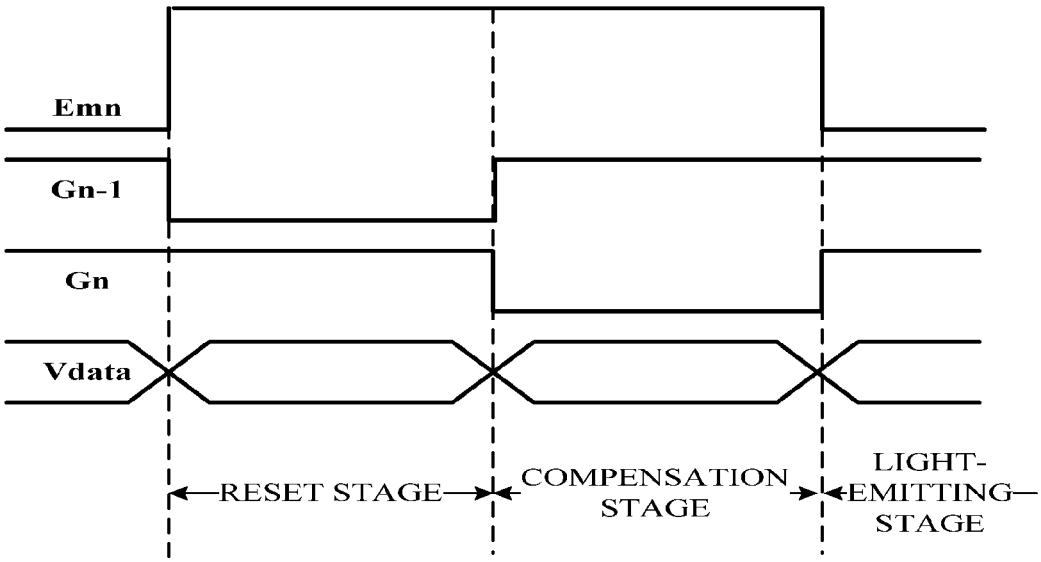
FIG. 5 shows a signal time chart of the driving circuit shown in FIG. 4.

FIG. 5 is a signal time chart of the driving circuit shown in FIG. 4.

Figure 6:
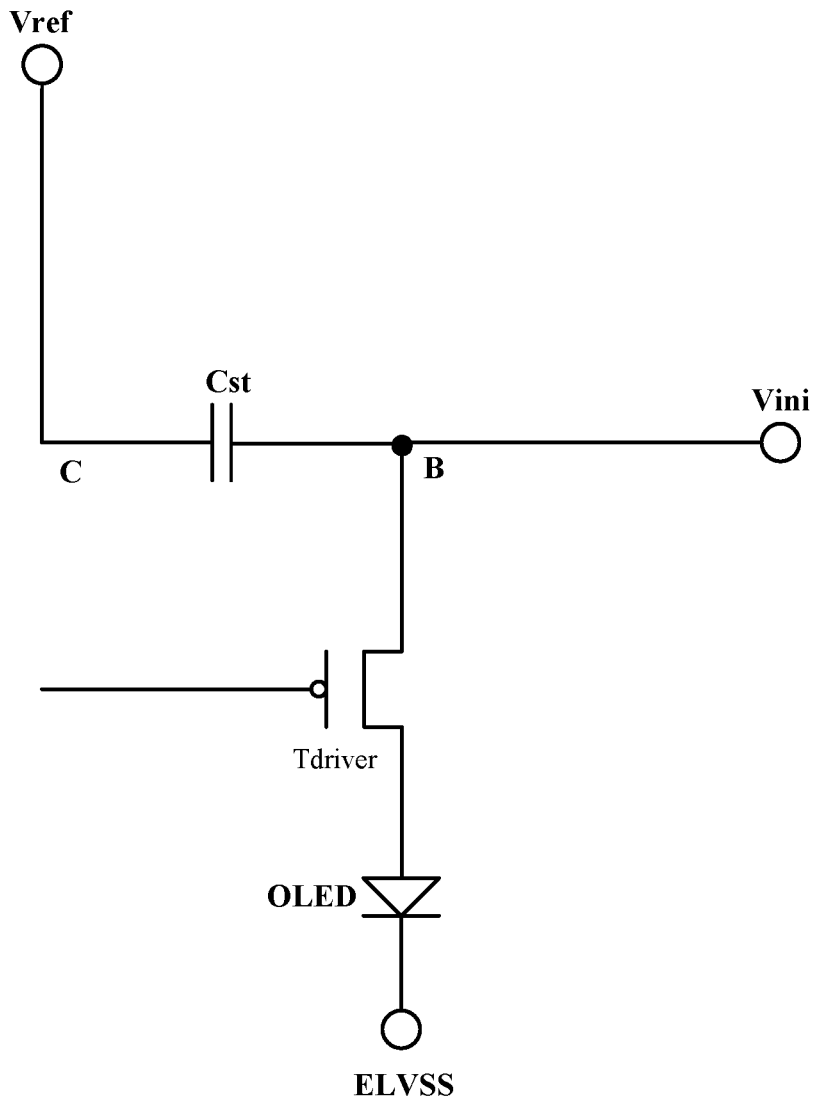
FIG. 6 shows an equivalent circuit of the driving circuit shown in FIG. 4 during a charging stage.

With reference to FIG. 4 and FIG. 5, during a reset stage, Gn−1 is of a low level, and Gn, Emn are of high levels. Thus, T1, T2, T4, and T5 are turned off, and T3 and T6 are turned on. A corresponding equivalent circuit is as shown in FIG. 6. At this time, the node B has a voltage of Vini, and node C has a voltage of Vref.

Figure 7:
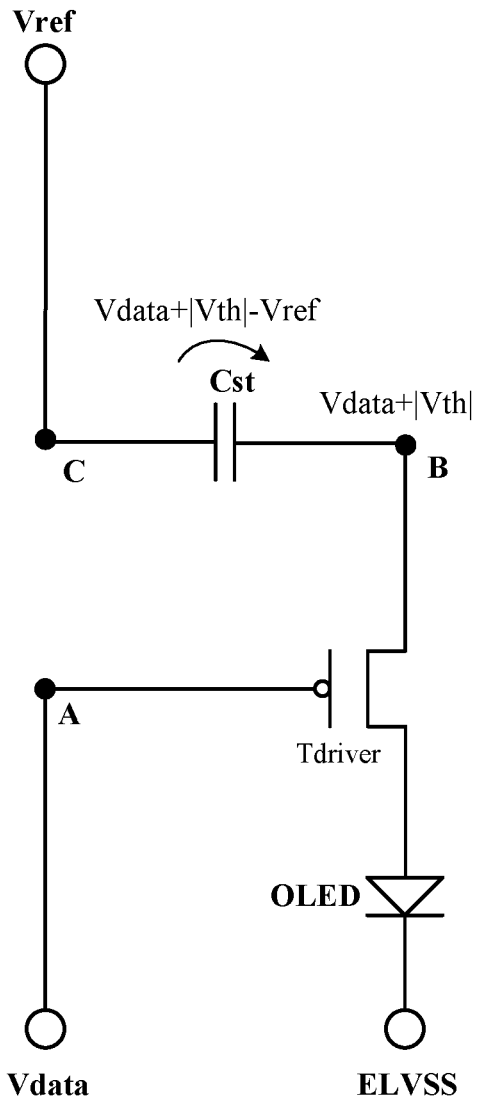
FIG. 7 shows an equivalent circuit of the driving circuit shown in FIG. 4 during a compensation stage.

When entering a compensation stage, Gn−1 is of a high level, Gn is of a low level, and Emn is of a high level. Thus, T2 and T4 are turned on, and T1, T3, T5 and T6 are turned off. An equivalent circuit of the driving circuit is shown in FIG. 7. At this time, the voltage of the node B discharges to a sum of Vdata and |Vth|, and the voltage of the node C becomes equal to Vref. Thus, the voltage difference between two ends of the capacitor Cst is Vdata+|Vth|−Vref.

Figure 8:
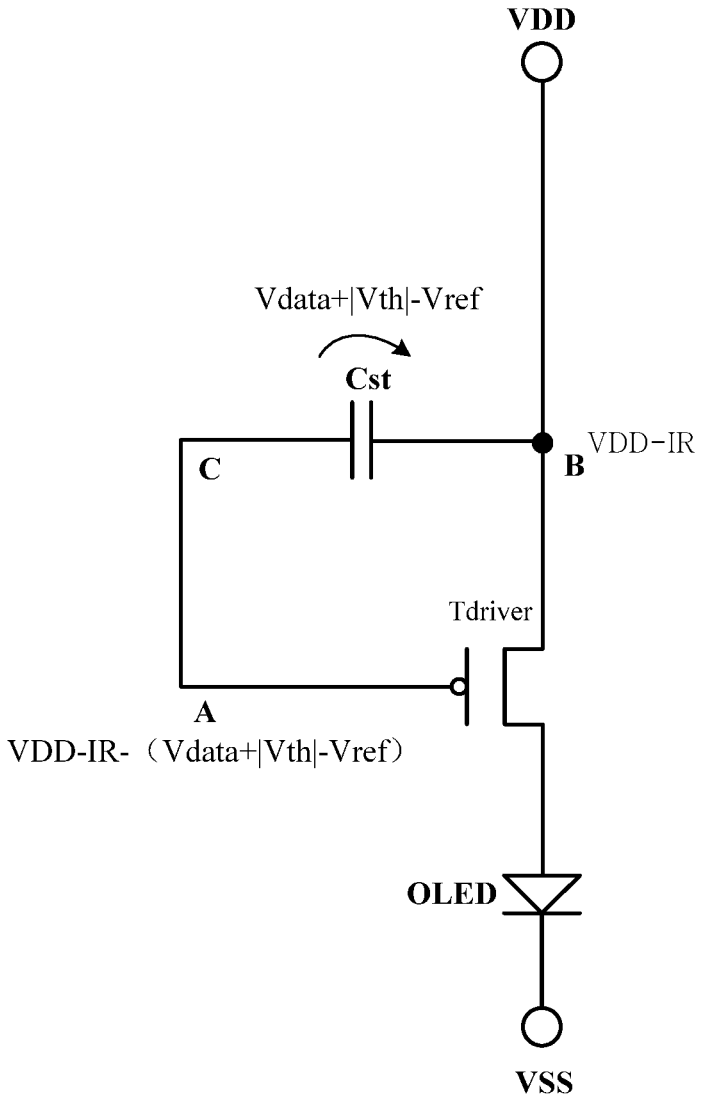
FIG. 8 shows an equivalent circuit of the driving circuit shown in FIG. 4 during a light-emitting stage.

When entering a light-emitting stage, Gn−1 and Gn are of high levels and Emn is of a low level. Thus, T1 and T5 are turned on, and T3, T4, T2, and T6 are turned off. An equivalent circuit of the driving circuit is shown in FIG. 8. At this time, the voltage value of the node B becomes VDD−IR. In order to maintain the voltage difference between two ends of the capacitor to be Vdata+|Vth|−Vref, the node A will be maintained at Vref+VDD−IR−Vdata−|Vth|. Thus, the current of this circuit is in proportion to $(Vdata-Vref)^2$, and has no relation to Vth or power source voltage drop IR.

A size of the driving transistor and a capacitance of the storage capacitor may substantially affect the compensation effect of the display performance. In an embodiment of the present disclosure, a ratio of the capacitance of the storage capacitor to a capacitance of a parasitic capacitor generated between the gate and drain electrodes of the driving TFT is controlled to range from 2:1 to 50:1. The larger the ratio, the better the compensation effect.

In the embodiments of the present disclosure, P-type transistor is described as an example of the transistor. It should be understood that, each P-type transistor can be replaced by an N-type thin film transistor or a CMOS transistor while a corresponding timing sequence design can be adopted. In this case, only the corresponding high and low levels need to be switched with each other. When the driving transistor is replaced, the position of the OLED and the power source signal design need to be adjust correspondingly. Since these factors are technical means well known by a person skilled in the art, detailed description will be omitted herein. In order to realize the above-described purpose, an embodiment of the present disclosure also discloses a display apparatus including the above-described OLED pixel circuit.

The display apparatus may be any product or component having a display function, such as a liquid crystal panel, an electronic paper, an OLED panel, a cellular phone, a flat panel computer, a television, a monitor, a laptop, a digital camera, and a navigation device.

Figure 9:
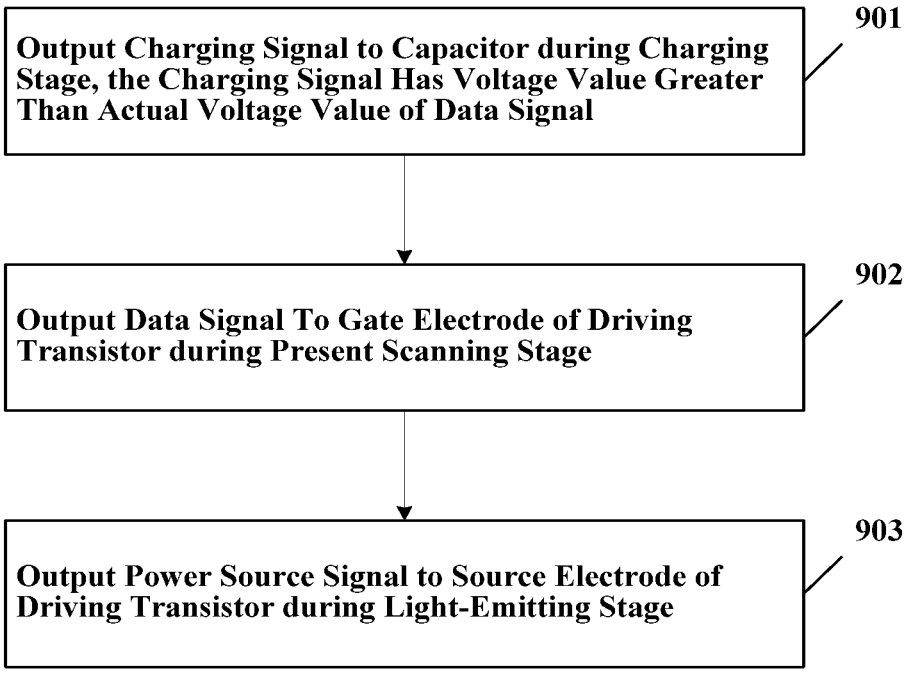
FIG. 9 is a flowchart showing a method according to an embodiment of the present disclosure.

An embodiment of the present disclosure also discloses a control method of the OLED pixel circuit. Here, the OLED pixel circuit includes a compensation unit which has a capacitor. The control method is shown in FIG. 9. The control method includes:

a charging control step 901 of outputting, during a charging stage, a charging signal to the capacitor for charging the capacitor so that the capacitor is capable of maintaining a voltage of the gate electrode of a driving transistor during a light-emitting stage, the charging signal having a voltage value greater than an actual voltage value of a data signal;

a writing step 902 of writing, during a present scanning stage, the data signal to a gate electrode of the driving transistor; and a light-emitting step 903 of outputting, during a light-emitting stage, a power source signal to a source electrode of the driving transistor.

The charging signal can be designed in the following two ways.

First, the charging signal for different frames is identical, and the voltage value of the charging signal is greater than a maximum value of possible voltage values of the data signal.

Second, there is a corresponding charging signal for each frame, and a voltage value of the charging signal is equal to a sum of the actual voltage value of the data signal outputted for a corresponding frame during the scanning stage and a predetermined voltage value set to be greater than zero.

A start time of the charging stage may be identical to a start time of the present scanning stage, and an end time of the charging stage may be earlier than an end time of the present scanning stage.

Alternatively, an end time of the charging state may be earlier than a start time of the present scanning stage. Specifically, the charging stage may be the previous scanning stage.

The above are merely the preferred embodiments of the present disclosure. Obviously, a person skilled in the art may make further modifications and improvements without departing from the principle of the present disclosure, and these modifications and improvements shall also fall within the scope of the present disclosure.

What is claimed is:

1. An organic light-emitting diode (OLED) pixel circuit, comprising:

an OLED;

a driving transistor, a drain electrode of which is connected with the OLED;

a first switching unit which is connected with a source electrode of the driving transistor and configured to output a power source signal to the source electrode of the driving transistor during a light-emitting stage;

a second switching unit which is connected with a gate electrode of the driving transistor and configured to receive a data signal and output the data signal to the gate electrode of the driving transistor during a present scanning stage;

a compensation unit including a capacitor, the compensation unit being connected with the gate electrode and the source electrode of the driving transistor, a first end of the capacitor being connected with the source electrode of the driving transistor, and the compensation unit being configured to maintain a voltage of the gate electrode of the driving transistor during the light-emitting stage so that a current flowing through the OLED has no relation to a threshold voltage Vth of the driving transistor;

a third switching unit which is connected with the source electrode of the driving transistor and configured to output, during a charging stage, a charging signal to the capacitor to charge the capacitor so that the capacitor is capable of maintaining the voltage of the gate electrode of the driving transistor during the light-emitting stage, a voltage value of the charging signal being greater than an actual voltage value of the data signal; and a signal generation unit configured to generate and output the charging signal, wherein the third switching unit is a thin film transistor, a source electrode of which is connected with an output end of the signal generation unit, a drain electrode of which is connected with the source electrode of the driving transistor, a gate electrode of which is connected with an output end of a previous scanning signal, and which is turned on when the previous scanning signal is in an effective state, and wherein the previous scanning signal is in the effective state during a previous scanning stage.

2. The OLED pixel circuit according to claim 1, wherein the charging signal for different frames is identical, and the voltage value of the charging signal is greater than a maximum value of possible voltage values of the data signal.

3. The OLED pixel circuit according to claim 1, wherein there is a corresponding charging signal for each frame, and a voltage value of the charging signal is equal to a sum of the actual voltage value of the data signal outputted for a corresponding frame during the scanning stage and a predetermined voltage value set to be greater than zero.

4. The OLED pixel circuit according to claim 1, wherein the first switching unit is a thin film transistor, a source electrode of which is connected with an output end of a power source signal, a drain electrode of which is connected with the source electrode of the driving transistor, a gate electrode of which is connected with an output end of a light-emitting control signal, and which is turned on when the light-emitting control signal is in an effective state, wherein the light-emitting control signal is in the effective state during the light-emitting stage, and the second switching unit is a thin film transistor, a source electrode of which is connected with an output end of the data signal, a drain electrode of which is connected with the gate electrode of the driving transistor, a gate electrode of which is connected with an output end of a present scanning signal, and which is turned on when a present scanning signal is in an effective state, wherein the present scanning signal is in the effective state during the present scanning stage.

5. The OLED pixel circuit according to claim 1, wherein the compensation unit further includes:

a fourth switching unit configured to output, during a present scanning stage, a reference voltage to a second end of the capacitor; and a fifth switching unit configured to electrically connect, during the light-emitting stage, the second end of the capacitor with the gate electrode of the driving transistor.

6. The OLED pixel circuit according to claim 5, wherein the fourth switching unit is a thin film transistor, a source electrode of which is connected with an output end of a reference signal, a drain electrode of which is connected with the second end of the capacitor, a gate electrode of which is connected with an output end of a present scanning signal, and which is turned on when the present scanning signal is in an effective state, wherein the present scanning signal is in the effective state during the present scanning stage, and the fifth switching unit is a thin film transistor, a source electrode of which is connected with the gate electrode of the driving transistor, a drain electrode of which is connected with the second end of the capacitor, a gate electrode of which is connected with an output end of a light-emitting control signal, and which is turned on when the light-emitting control signal is in an effective state, wherein the light-emitting control signal is in the effective state during the light-emitting stage.

7. The OLED pixel circuit according to claim 1, wherein a start time of the charging stage is identical to a start time of the present scanning stage, and an end time of the charging stage is earlier than an end time of the present scanning stage.

8. The OLED pixel circuit according to claim 1, wherein an end time of the charging stage is earlier than a start time of the present scanning stage.

9. The OLED pixel circuit according to claim 8, further comprising a thin film transistor, a source electrode of which is connected with an output end of a reference signal, a drain electrode of which is connected with a second end of the capacitor, a gate electrode of which is connected with an output end of the previous scanning signal, and which is turned on when the previous scanning signal is in an effective state, wherein the previous scanning signal is in the effective state during the previous scanning stage.

10. A display apparatus, comprising the OLED pixel circuit according to claim 1.

11. A control method of the OLED pixel circuit according to claim 1, the control method comprising:

a charging control step of outputting, during a charging stage, a charging signal to the capacitor for charging the capacitor so that the capacitor is capable of maintaining a voltage of a gate electrode of a driving transistor during a light-emitting stage, the charging signal having a voltage value greater than an actual voltage value of a data signal;

a writing step of outputting, during a present scanning stage, the data signal to the gate electrode of the driving transistor; and a light-emitting step of outputting, during a light-emitting stage, a power source signal to a source electrode of the driving transistor.

12. The control method according to claim 11, wherein the charging signal for different frames is identical, and the voltage value of the charging signal is greater than a maximum value of possible voltage values of the data signal.

13. The control method according to claim 11, wherein there is a corresponding charging signal for each frame, and a voltage value of the charging signal is equal to a sum of the actual voltage value of the data signal outputted for a corresponding frame during the scanning stage and a predetermined voltage value set to be greater than zero.

14. The control method according to claim 11, wherein a start time of the charging stage is identical to a start time of the present scanning stage, and an end time of the charging stage is earlier than an end time of the present scanning stage.

15. The control method according to claim 11, wherein an end time of the charging stage is earlier than a start time of the present scanning stage.

16. The control method according to claim 15, wherein the charging stage is a previous scanning stage.

17. The OLED pixel circuit according to claim 1, wherein the first switching unit is a thin film transistor, a source electrode of which is connected with an output end of a power source signal, a drain electrode of which is connected with the source electrode of the driving transistor, a gate electrode of which is connected with an output end of a light-emitting control signal, and which is turned on when the light-emitting control signal is in an effective state, wherein the light-emitting control signal is in the effective state during the light-emitting stage, and the second switching unit is a thin film transistor, a source electrode of which is connected with an output end of the data signal, a drain electrode of which is connected with the gate electrode of the driving transistor, a gate electrode of which is connected with an output end of a present scanning signal, and which is turned on when a present scanning signal is in an effective state, wherein the present scanning signal is in the effective state during the present scanning stage.

18. The OLED pixel circuit according to claim 1, wherein the compensation unit further includes:

a fourth switching unit configured to output, during a present scanning stage, a reference voltage to a second end of the capacitor; and a fifth switching unit configured to electrically connect, during the light-emitting stage, the second end of the capacitor with the gate electrode of the driving transistor.

* * * * *